US008339433B2

(12) United States Patent
Tewinkle

(10) Patent No.: US 8,339,433 B2
(45) Date of Patent: Dec. 25, 2012

(54) ALTERNATE MATRIX DRIVE METHOD FOR A 1200DPI LED PRINT-HEAD

(75) Inventor: Scott L. Tewinkle, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 104 days.

(21) Appl. No.: 12/858,753

(22) Filed: Aug. 18, 2010

(65) Prior Publication Data

US 2012/0044317 A1 Feb. 23, 2012

(51) Int. Cl.
*B41J 2/435* (2006.01)
*B41J 2/45* (2006.01)

(52) U.S. Cl. ..... 347/238; 347/237; 347/247

(58) Field of Classification Search ..... None
See application file for complete search history.

(56) References Cited

U.S. PATENT DOCUMENTS

| | | | | |
|---|---|---|---|---|
| 4,587,717 | A * | 5/1986 | Daniele et al. | 438/21 |
| 5,153,608 | A | 10/1992 | Genovese | |
| 5,168,283 | A | 12/1992 | Hammond et al. | |
| 2009/0060581 | A1 * | 3/2009 | Nakasendo | 399/220 |

* cited by examiner

*Primary Examiner* — Matthew Luu
*Assistant Examiner* — Kendrick Liu
(74) *Attorney, Agent, or Firm* — Simpson & Simpson, PLLC

(57) ABSTRACT

A print head, including: a plurality of chips disposed in a linear array; respective pluralities of first and second matrix drivers on each the chip connected to first and second channels, respectively; and for each chip, first groups of light-emitting diodes (LEDs). Each first group of LEDs includes: a second group of LEDs, with a first number of LEDs, connected to a respective first matrix driver; and a third group of LEDs, with the first number of LEDs, connected to a respective second matrix driver. LEDs in each first group of LEDs are disposed in a staggered arrangement; and the respective pluralities of first and second matrix drivers are for activating in sequence the LEDs in the second and third groups of LEDs, respectively.

6 Claims, 15 Drawing Sheets

ALTERNATE MATRIX DRIVE METHOD FOR A 1200DPI LED PRINT-HEAD

TECHNICAL FIELD

The present disclosure relates to a light-emitting diode (LED) print-head with multiple resolution capability and a method of operating a LED print-head at multiple resolutions. Specifically the print-head and method include groups of LEDs with individual LEDs in the groups alternately disposed with each other, and independent control of the LEDs.

BACKGROUND

FIG. 1 schematically shows prior art image recording apparatus 100 with light-emitting diode (LED) print-head 101. Full width array imagers used in image recording systems are generally comprised of a linear array of discrete sources. The sources may emit ink, ions, or light. Examples of full width array imagers include wire dot, electrostatic, ink jet, and thermal print heads. Print-head 101 is an example of an LED full width array imager. An LED full width array imager consists of an arrangement of a large number of closely spaced LEDs in a linear array. By providing relative motion between the LED printbar and a photoreceptor in a process direction, and by selectively energizing the LEDs at the proper times in a scan direction, a desired latent electrostatic image can be produced on the recording member. The production of a desired latent image is usually performed by having each LED expose a corresponding pixel on the recording member in accordance with image-defining video data information applied to the printbar through driver circuitry. Conventionally, digital data signals from a data source, which may be a Raster Input Scanner (RIS), a computer, a word processor or some other source of digitized image data is clocked into a shift register. Some time after the start of a line signal, individual LED drive circuits are then selectively energized to control the on/off timing of currents flowing through the LEDs. The LEDs selectively turn on and off at fixed intervals to form a line exposure pattern on the surface of the photoreceptor. A complete image is formed by successive line exposures.

The following provides further detail regarding prior art apparatus 100. Print-head 101 includes: LED's controlled according to recording signals supplied from an unrepresented external device; a rotary drum 102 provided with a photosensitive member along the periphery thereof; a rod lens array 103 for focusing the light beams of the LED's in the printing head 101 onto the photosensitive surface of the drum 102; a corona charger 104 for charging the photosensitive member in advance; a developing station 105 for developing an electrostatic latent image with toner; a recording sheet 106; a cassette 107 housing a plurality of recording sheets 106; a feed roller 108 for feeding the recording sheet 106 from the cassette 107; registration rollers 109 for matching the front end of the recording sheet with the leading end of the image formed on the drum 102; a transfer charger 110 for transferring the developed image from the drum 102 onto the recording sheet 106; a separating roller 111 for separating the recording sheet from the drum 102; a belt 112 for transporting the recording sheet; fixing rollers 113; discharge rollers 114 for discharging the recording sheet onto a tray 115; a blade cleaner 116 for removing the toner remaining on the drum 102; a container 117 for the recovered toner; and a lamp 118 for eliminating charge remaining on the drum 102.

The function of the above-described apparatus is as follows. Upon turning on of an unrepresented main switch, there are activated a motor for rotating the drum 102, the lamp 118 and the corona charger 104, thus eliminating the toner, charge and hysteresis remaining on the drum. Then a recording enable signal is released to the external device when the fixing rollers 113 reach a fixing temperature by means of an internal heater.

In response to recording information supplied from the external device, the LED's in the printing head 101 emit light beams which are guided to the drum 102 through the rod lens array 103. The charge formed on the drum 102 by the charger 104 is selectively eliminated, in the exposure position, by the light beams from the printing head 101, thus forming an electrostatic latent image on the drum. The latent image is rendered visible by toner deposition in the developing station 105, and the visible image thus obtained is transferred onto the recording sheet by means of the transfer charger 110. The recording sheet is supplied from the cassette 107 by the timed function of the feed roller 103, and passes through the image transfer position, by means of the registration rollers 109, at a speed same as the peripheral speed of the drum.

After the image transfer; the recording sheet is separated by the separating roller 111, then supplied by the belt 112 to the fixing rollers 113 for image fixation, and discharged by the roller 114 onto the tray 115. The drum surface after the image transfer is cleaned with the blade cleaner 116 and is exposed to the light from the lamp 118 for erasing the hysteresis.

Matrix drive is used with high resolution light-emitting diode (LED) print-heads to reduce power dissipation and the number of wire bonds, enabling such print-heads to be made smaller, cheaper and more easily, for example, as taught by U.S. Pat. No. 6,172,701. Additionally, technology has been developed that enables LEDs and drivers to be integrated onto one CMOS substrate further increasing size, cost and reliability, for example, as taught by the website: "http://www.oki-.com/en/press/2006/z06085e.html"

FIG. 2A illustrates prior art 1200 dots per inch (dpi), scan direction, print-head 150 implementing a matrix drive with an integrated LED/Driver. FIG. 2B is a block diagram of chips from print-head 150 in FIG. 2A. Groups 156 of LEDs 152 are connected appropriately to enable "⅛" matrix drive (only one of eight LEDs are strobed at any time during printing). A single matrix driver 158 controls all the LEDs in each group 156. In the example, there is an array of 15360 LEDs 102 constructed from 40 individual LED/Driver chips 154, where within each LED/Driver chip the LEDs are sectioned into 48 groups of eight LEDs.

FIG. 2C shows a group 156 of LEDs for a chip in FIG. 2A. The LEDs within each group of LEDs are arranged at 1200 dpi in the scan direction and offset in the process direction by ⅛ of a 2400 dpi to enable 2400 dpi resolution in process direction P.

A prior art LED print-head, such as 101 or 150, is limited both by time and power constraints. For example, the print-head is constrained by the amount of image data that can be transferred to and accepted by the individual LEDs within a certain time period. If incomplete data is transferred and accepted, respective printing operations are degraded. In general, it is desirable to minimize this time period to optimize printing rates. However, at the same time, there must be sufficient time to discharge the individual LEDs on respective desired pixel areas while a recording sheet is moving in the process direction. If, in the interest of increasing printing rate, there is insufficient power or time to properly strobe the individual LEDs, printing quality suffers.

FIG. 3A is a prior art matrix drive timing chart for the group of LEDs shown in FIG. 2C. Print-head 100 is able to print at both 1200 dpi×2400 dpi (scan×process) and 1200 dpi×1200 dpi using "⅛" matrix drive timing as shown in FIG. 3A. However, as shown below, printing at 1200 dpi×1200 dpi results in poor performance.

FIG. 3B shows respective spot images 160 for LEDs 152 in FIG. 2C at 1200 dpi×2400 dpi resolution according to the chart of FIG. 3A. This figure shows acceptable alignment of spot images for 1200 dpi×2400 dpi printing.

FIG. 3C shows respective spot images 160 for LEDs 152 in FIG. 2C at 1200 dpi×1200 dpi resolution according to the chart of FIG. 3A. Because the offset of the LED arrangement (⅛ at 2400 dpi) does not match the strobe timing interval (⅛ at 1200 dpi), 1200 dpi×1200 dpi printing with "⅛" matrix drive results in a misalignment (spot alignment error) of 7D/8 for each group of LEDs. This misalignment results in degradation of print quality.

FIG. 4A is a prior art matrix drive timing chart. FIG. 4B shows respective spot images 160 for LEDs 152 in FIG. 2C at 1200 dpi×1200 dpi resolution according to the chart of FIG. 4A. FIGS. 4A and 4B illustrate a prior art approach for 1200 dpi×1200 dpi printing. To address the misalignment problem for 1200 dpi×1200 dpi printing shown in FIG. 3C, it is known to print at the process speed for 2400 dpi but ignore every other line. This eliminates the misalignment but significantly reduces print speed. As shown in FIG. 4A and 4B, it is possible to compress the strobe time from "⅛" to "1/16" of a 1200 dpi line to eliminate the error. However, such a compression falls prey to the time and power constraints noted supra. For example, such compression reduces the maximum power of LEDs 152 by at least 50% and, as a result, either doubles the print data rate or halves the print speed when compared to 2400 dpi, both of which are undesirable.

SUMMARY

According to aspects illustrated herein, there is provided a print head, including: a plurality of chips disposed in a linear array; respective pluralities of first and second matrix drivers on each the chip connected to first and second channels, respectively; and for each chip, first groups of light-emitting diodes (LEDs). Each first group of LEDs includes: a second group of LEDs, with a first number of LEDs, connected to a respective first matrix driver; and a third group of LEDs, with the first number of LEDs, connected to a respective second matrix driver. LEDs in each first group of LEDs are disposed in a staggered arrangement; and the respective pluralities of first and second matrix drivers are for activating in sequence the LEDs in the second and third groups of LEDs, respectively.

According to aspects illustrated herein, there is provided a method of operating a print head, including: disposing a plurality of chips in a linear array in the print head, each chip including first groups of light-emitting diodes (LEDs), and each first group of LEDs including a second group of LEDs, with a first number of LEDs and a third group of LEDs, with the first number of LEDs; connecting respective pluralities of first and second matrix drivers on each chip to first and second channels, respectively; connecting the second and third groups of LEDs to respective first and second matrix drivers, respectively; disposing LEDs in each first group of LEDs in a staggered arrangement; and activating in sequence the LEDs in the second and third groups of LEDs using the respective first and second matrix drivers, respectively.

According to aspects illustrated herein, there is provided a print head, including: a plurality of chips disposed in a linear array; respective pluralities of first and second matrix drivers on each the chip connected to first and second channels, respectively; and for each chip, a group of light-emitting diodes (LEDs). Each group of LEDs includes: a group of odd LEDs, with a first number of LEDs, connected to a respective first matrix driver; and a group of even LEDs, with the first number of LEDs, connected to a respective second matrix driver. LEDs in each group of LEDs are disposed in a staggered arrangement, with LEDs from the group of odd LEDs alternating with LEDs from the group of even LEDs in the staggered arrangement; and the respective pluralities of first and second matrix drivers are for: controlling each LED in each group of LEDs such that each LED is activated within a time period; and separating activation of adjacent LEDs in the linear arrangement by one half the time period.

According to aspects illustrated herein, there is provided a method of operating a print head, including: disposing a plurality of chips in a linear array in the print head, each chip including groups of light-emitting diodes (LEDs), and each group of LEDs including a group of odd LEDs with a first number of LEDs and a group of even LEDs with the first number of LEDs; connecting respective pluralities of first and second matrix drivers on each chip to first and second channels, respectively; connecting the groups of odd and even LEDs to respective first and second matrix drivers, respectively; disposing LEDs in each group of LEDs in a staggered arrangement, with LEDs from the group of odd LEDs alternating with LEDs from the group of even LEDs in the staggered arrangement; and operating the respective first and second matrix drivers such that: each LED is activated with a time period; and activation of adjacent LEDs in the staggered arrangement is separated by one half the time period.

According to aspects illustrated herein, there is provided a print head, including: a plurality of chips disposed in a linear array; respective pluralities of first and second matrix drivers on each chip connected to first and second channels, respectively; and for each chip, groups of light-emitting diodes (LEDs). Each group of LEDs includes: a first number of LEDs; a group of odd LEDs, with half the first number of LEDs, connected to a respective first matrix driver; and a group of even LEDs, with half the first number of LEDs, connected to a respective second matrix drive. A scan line time for the print-head is a time period between initiation of a first scan line and initiation of a next scan line. For operation of the print-head at a first resolution in a process direction, adjacent scan lines are separated by a first distance in the process direction. For operation of the print-head at a second resolution, twice the first resolution, in the process direction, adjacent scan lines are separated by a second distance, equal to one half the first distance, in the process direction. LEDs in the group of odd LEDs alternate, in a staggered arrangement, with LEDs from the group of even LEDs. The respective pluralities of first and second matrix drivers are for activating, in sequence according to the staggered arrangement, LEDs in each group of LEDs such that for operation of the print-head at the first resolution in a scan direction and for operation of the print-head at either the first resolution or the second resolution in the process direction: respective spot images for each group of LEDs are substantially fully aligned in the scan direction; and for each LED in the group of LEDs, a time required for activating each LED is no less than the time period for a scan line divided by the first number.

According to aspects illustrated herein, there is provided a method of operating a print head. A scan line time for the print-head is a time period between initiation of a first scan line and initiation of a next scan line. For operation of the print-head at a first resolution in a process direction, adjacent scan lines are separated by a first distance in the process direction. For operation of the print-head at a second resolution, twice the first resolution, in the process direction, adjacent scan lines are separated by a second distance, equal to one half the first distance, in the process direction. The method includes: disposing a plurality of chips in a linear array in the print head. Each chip includes groups of light-emitting diodes (LEDs), and each group of LEDs includes: a first number of LEDs; a group of odd LEDs with half the first number of LEDs; and a group of even LEDs with half the first number of LEDs. The method includes: connecting a respective pluralities of first and second matrix drivers on each chip to first and second channels, respectively; connecting the groups of odd and even LEDs to respective first and second matrix drivers, respectively; disposing LEDs from the group of odd LEDs alternately with LEDs from the group of even LEDs in a linear arrangement; and activating, in sequence according to the staggered arrangement and using the respective first and second matrix drivers, LEDs in each group of LEDs such that for operation of the print-head at the first resolution in a scan direction and for operation of the print-head at either the first resolution or the second resolution in the process direction: respective spot images for each group of LEDs are substantially fully aligned in the scan direction; and a time required for activating each LED is no less than the time period for a scan line divided by the first number.

According to aspects illustrated herein, there is provided a print head, including: a plurality of chips disposed in a linear array; respective pluralities of first and second matrix drivers on each chip connected to first and second channels, respectively; and for each chip, groups of light-emitting diodes (LEDs). Each group of LEDs includes: a group of odd LEDs, with a first number of LEDs, connected to a respective first matrix driver; and a group of even LEDs, with the first number of LEDs, connected to a respective second matrix driver. LEDs in each group of LEDs are disposed in a staggered arrangement, with LEDs from the group of odd LEDs alternating with LEDs from the group of even LEDs in the staggered arrangement. The respective first and second matrix drivers are for alternately activating individual LEDs in the group of odd LEDs and individual LEDs in the group of odd LEDs, respectively, in sequence according to the staggered arrangement, starting with a first odd LED from the group of odd LEDs, the first odd LEDs being an LED at one end of the staggered arrangement. A first time interval between activation of adjacent LEDs in the staggered arrangement is equal to the time period divided by a first value, the first value selected according to a desired resolution of the print head.

According to aspects illustrated herein, there is provided a method of operating a print head, including: disposing a plurality of chips in a linear array in the print head, each chip including groups of light-emitting diodes (LEDs), and each group of LEDs including a group of odd LEDs with a first number of LEDs and a group of even LEDs with the first number of LEDs; connecting respective pluralities of first and second matrix drivers on each chip to first and second channels, respectively; connecting the groups of odd and even LEDs to respective first and second matrix drivers, respectively; disposing LEDs in each group of LEDs in a staggered arrangement, with LEDs from the group of odd LEDs alternating with LEDs from the group of even LEDs in the staggered arrangement; alternately activating, using the respective first and second matrix drivers, individual LEDs in the group of odd LEDs and individual LEDs in the group of odd LEDs, respectively, in sequence according to the staggered arrangement, starting with a first odd LED from the group of odd LEDs, the first odd LEDs being an LED at one end of the staggered arrangement; and separating activation of adjacent LEDs in the staggered arrangement by a first time interval equal to the time period divided by a first value, the first value selected according to a desired resolution of the print head.

According to aspects illustrated herein, there is provided a chip for a print head, including: first and second pluralities of matrix drivers connected to first and second channels, respectively; and first groups of light-emitting diodes (LEDs), each first group of LEDs including: a second group of LEDs, with a first number of LEDs, connected to a respective first matrix driver; and a third group of LEDs, with the first number of LEDs, connected to a respective second matrix driver. LEDs in each first group of LEDs are disposed in a staggered arrangement; and the first and second pluralities of matrix drivers are for activating in sequence the LEDs in the second and third groups of LEDs, respectively.

According to aspects illustrated herein, there is provided a chip for a print head, including: first and second pluralities of matrix drivers connected to first and second channels, respectively; and a group of light-emitting diodes (LEDs). Each group of LEDs includes: a group of odd LEDs, with a first number of LEDs, connected to a respective first matrix driver; and a group of even LEDs, with the first number of LEDs, connected to a respective second matrix driver. LEDs in each group of LEDs are disposed in a staggered arrangement, with LEDs from the group of odd LEDs alternating with LEDs from the group of even LEDs in the staggered arrangement; and the first and second pluralities of matrix drivers are for: controlling each LED in each group of LEDs such that each LED is activated within a time period; and separating activation of adjacent LEDs in the staggered arrangement by one half the time period.

According to aspects illustrated herein, there is provided a chip for a print head, including: first and second pluralities of matrix drivers connected to first and second channels, respectively; and first groups of light-emitting diodes (LEDs), each first group of LEDs including: a second group of LEDs, with a first number of LEDs, connected to a respective first matrix driver; and a third group of even LEDs, with the first number of LEDs, connected to a respective second matrix driver. LEDs in each group of LEDs are disposed in a staggered arrangement; the first and second pluralities of matrix drivers are for activating LEDs in the second and third groups LEDs, respectively, according to the staggered arrangement; and a first time interval between activation of LEDs in the second and third groups is equal to the time period divided by a first value, the first value selected according to a desired resolution of the chip.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 4A:
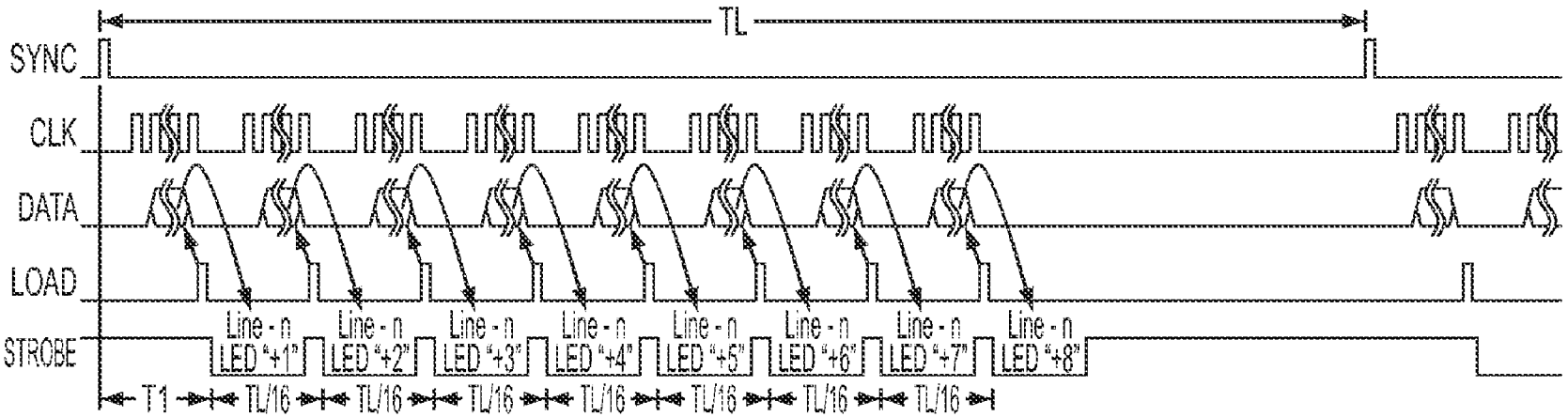
FIG. 4A PRIOR ART
FIG. 4A is a prior art matrix drive timing chart.
Figure 4B:
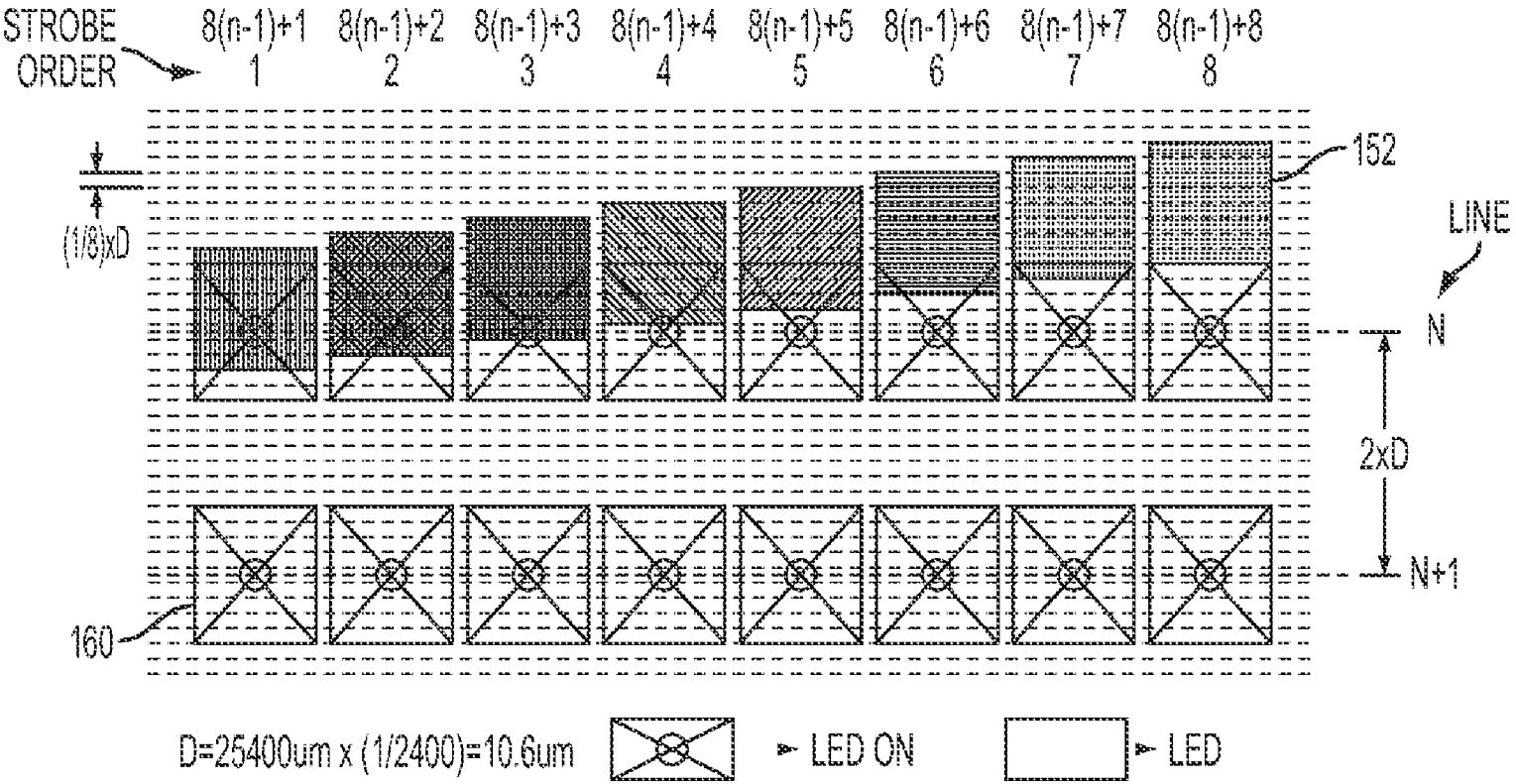
FIG. 4B PRIOR ART
FIG. 4B shows respective spot images for LEDs in FIG. 2C at 1200 dpi×1200 dpi resolution according to the chart of FIG. 4A.
Figure 5:
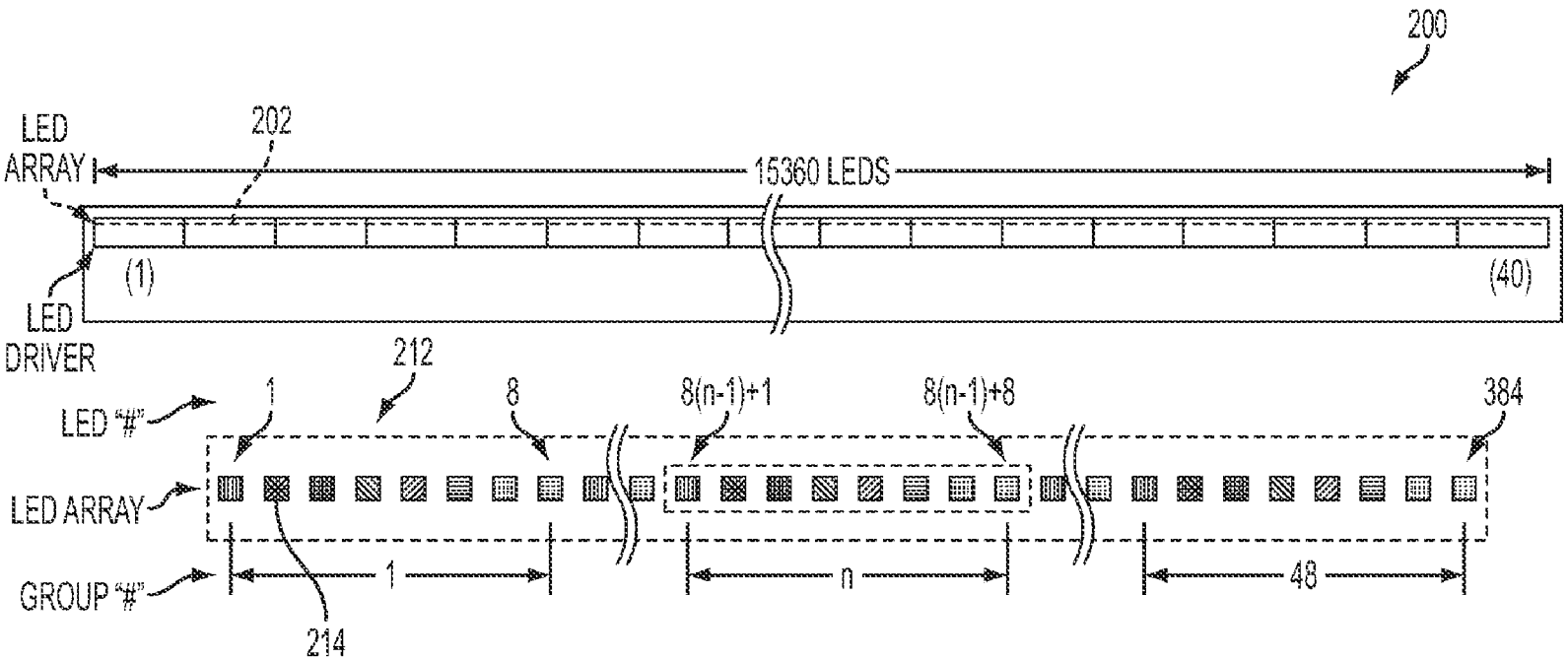
FIG. 5 illustrates a 1200 dots per inch (dpi), scan direction, print-head implementing independent matrix drive with integrated LED/Drivers.

FIG. 5 illustrates 1200 dots per inch (dpi), scan direction, print-head 200 implementing independent matrix drive with integrated LED/Drivers. Print head 200 includes a plurality of chips 202 disposed in a linear array. Although a specific number of chips and total LEDs is shown in FIG. 4, it should be understood that print-head 200 is not limited to the number of chips and total LEDs show and that other number of chips and total LEDs are possible. Pluralities of first and second matrix drivers on each chip are connected to first and second independent channels on each chip, respectively. Each chip includes groups 212 of LEDs 214 connected to a respective pair of the drivers noted above. Each group of LEDs includes a first number of LEDs. In an example embodiment, each group includes eight LEDs. However, it should be understood that group 212 is not limited to any particular number of LEDs.

Each group 212 of LEDs includes first and second groups, each group including, for example, one half the number of LEDs in group 212. The first and second groups are connected to respective matrix drivers from the first and second groups of matrix drivers, respectively. LEDs in group 212 are disposed in a staggered arrangement, and the pluralities of matrix drivers are for activating, in sequence, for example, according to the staggered arrangement, the first and second groups of LEDs in groups 212, respectively. By staggered arrangement, we mean that LEDs are sequentially and increasingly offset opposite process direction P. For example, moving in scan direction S from the left-most LED in a group, successive LEDs are increasingly off-set with respect to P. The staggered off-set is further described and shown infra. Thus, each chip includes groups 212 with semi-independent first and second groups of LEDs. These semi-independent groups can be controlled via respective matrix drivers to provide various functionality. For example, the LEDs in the first group could be aligned in a staggered row preceding the LEDs in the second group, also aligned in a staggered row. The first group and then the second group could be activated to provide longer exposure times for given pixel areas.

Figure 6:
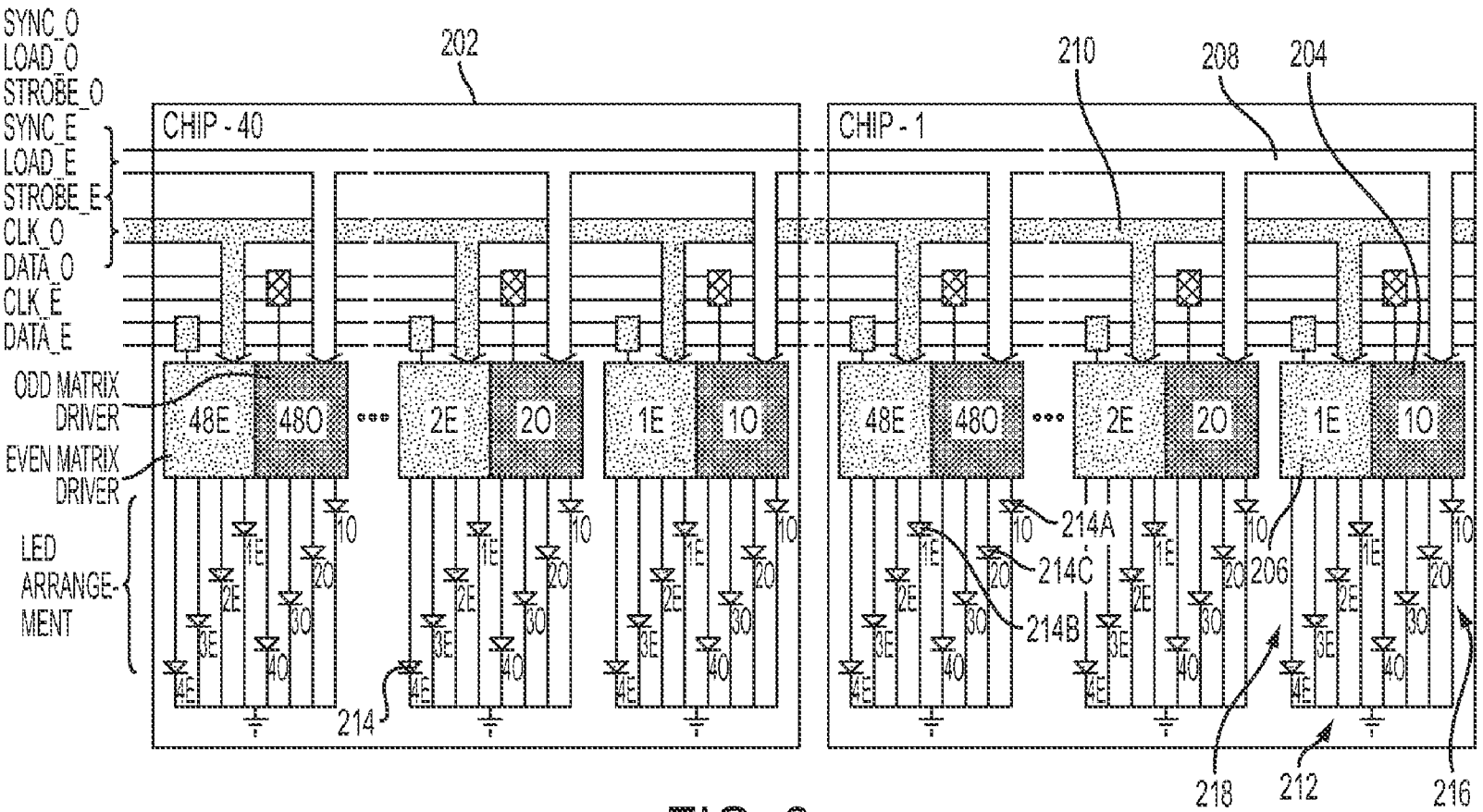
FIG. 6 is a block diagram of chips with groups of odd and even light-emitting diodes (LEDs) in the print-head shown in FIG. 5.

FIG. 6 is a block diagram of chips with groups of odd and even light-emitting diodes (LEDs) in print-head 200 shown in FIG. 5. The following should be viewed in light of FIGS. 5 and 6. In one embodiment, for example, as shown in FIG. 6, the first group of LEDs is group 216 consisting of odd LEDs, and the second group of LEDs is group 218 consisting of even LEDs. In one embodiment, each of groups 216 and 218 include four LEDs. LEDs in groups 216 alternate, in a linear arrangement, with LEDs from groups 218. For example, LEDs 214A/B/C are in sequence in the arrangement. Independent channels 208 and 210 include separate locks CLK_O and CLK_E and separate data lines DATA_O and DATA_E, respectively. Data lines DATA_O and DATA_E are for transmitting to drivers 204 and 206, respectively, data for use by groups 216 and 218, respectively, in a printing operation for print-head 200.

Figure 7:
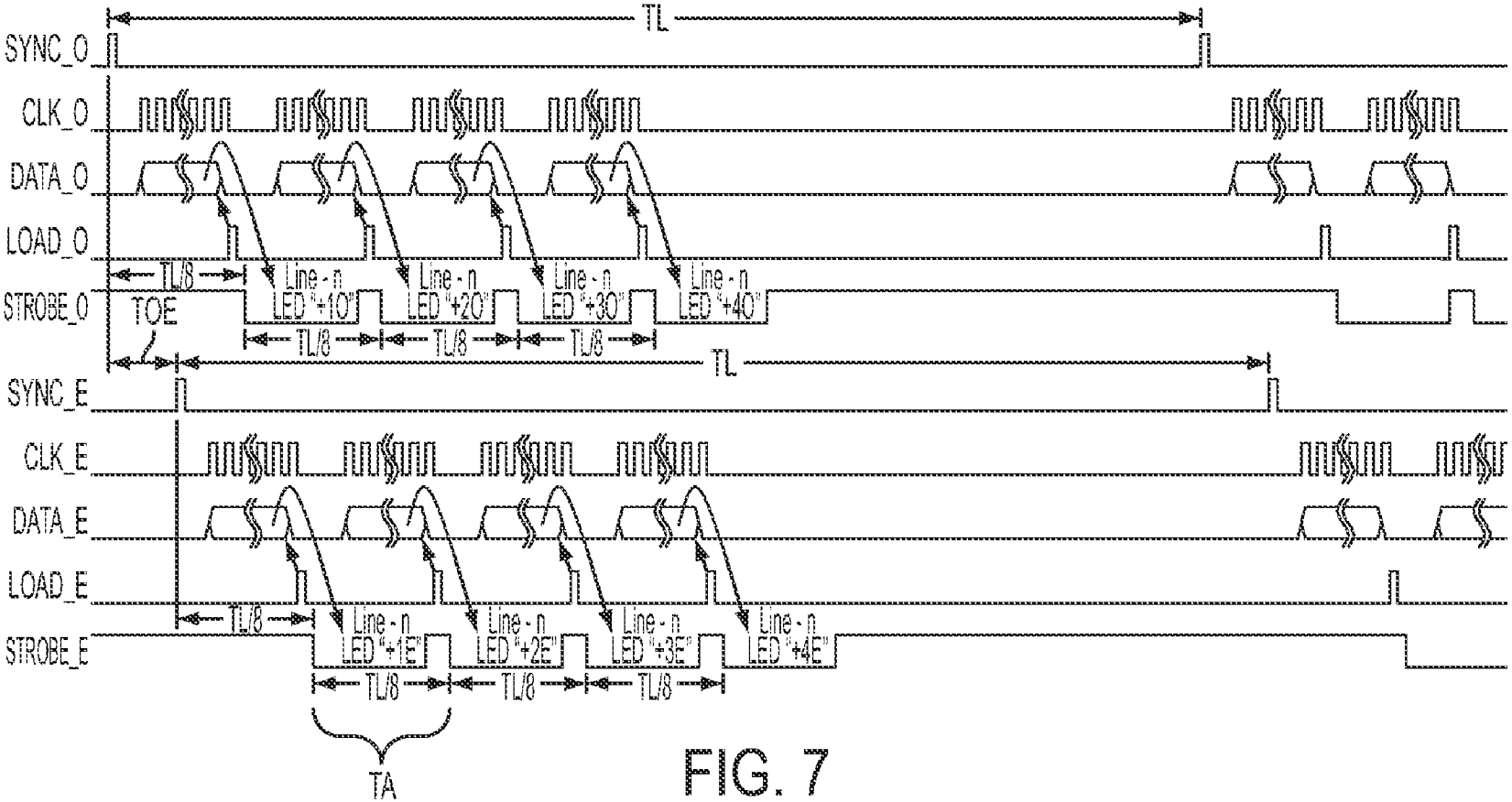
FIG. 7 is a matrix drive timing chart for 1200 dpi×2400 dpi printing using the configuration of FIGS. 5 and 6.

FIG. 7 is a matrix drive timing chart for 1200 dpi×1200 dpi printing using print-head 200 and the configuration of FIG. 5.

Figure 8:
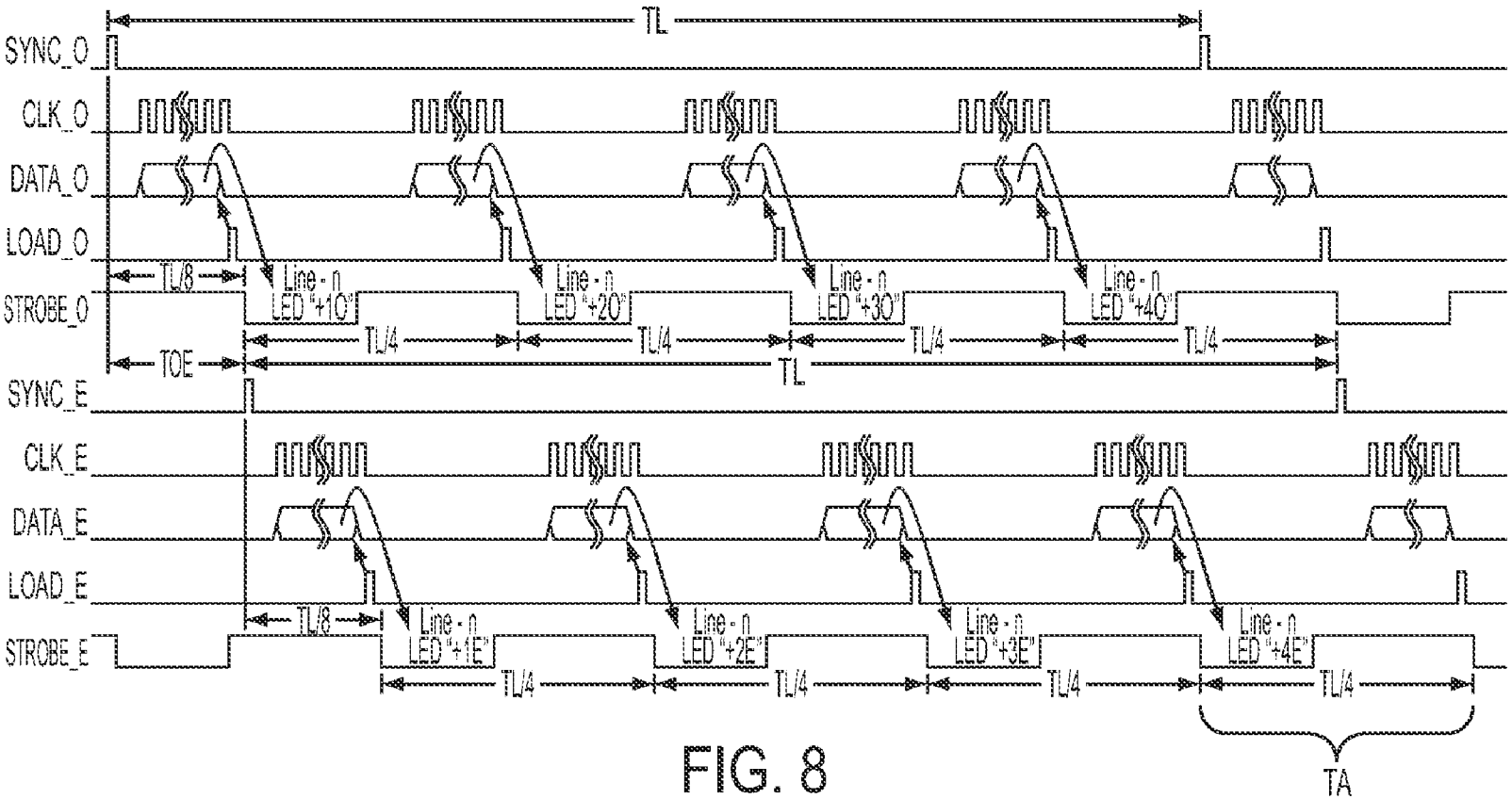
FIG. 8 is a matrix drive timing chart for 1200 dpi×1200 dpi printing using the configuration of FIGS. 5 and 6.

FIG. 8 is a matrix drive timing chart for 1200 dpi×2400 dpi printing using print-head 200 and the configuration of FIGS. 5 and 6. The following should be viewed in light of FIG. 5 through 8. Scan line time TL for print-head 200 is a time period between initiation of one scan line and initiation of a next scan line as shown in FIGS. 7 and 8. Matrix drivers 204 and 206 are for individually activating, in sequence according to the staggered arrangement, LEDs in each group 212 of LEDs. By activating, we mean receiving respective data for the LEDs, loading the respective data, and strobing (applying power to) the LEDs according to the respective data. For example, LEDs in groups 212 are activated in the following sequence: 1O, 1E, 2O, 2E, 3O, 3E, 4O, 4E. Matrix drivers 204 and 206 operate independently to implement the independent timing control of groups 216 and 218 discussed infra.

Each LED in group 216 or 218 is activated within a same time period TA, for example, TL/8 in FIG. 7 and TL/4 in FIG. 8. The activation of adjacent LEDs in the linear arrangement is offset by TOE, or one half TA. For example, in FIG. 7, the activation of LED 1E follows the activation of LED 1O by TL/16.

Figure 9:
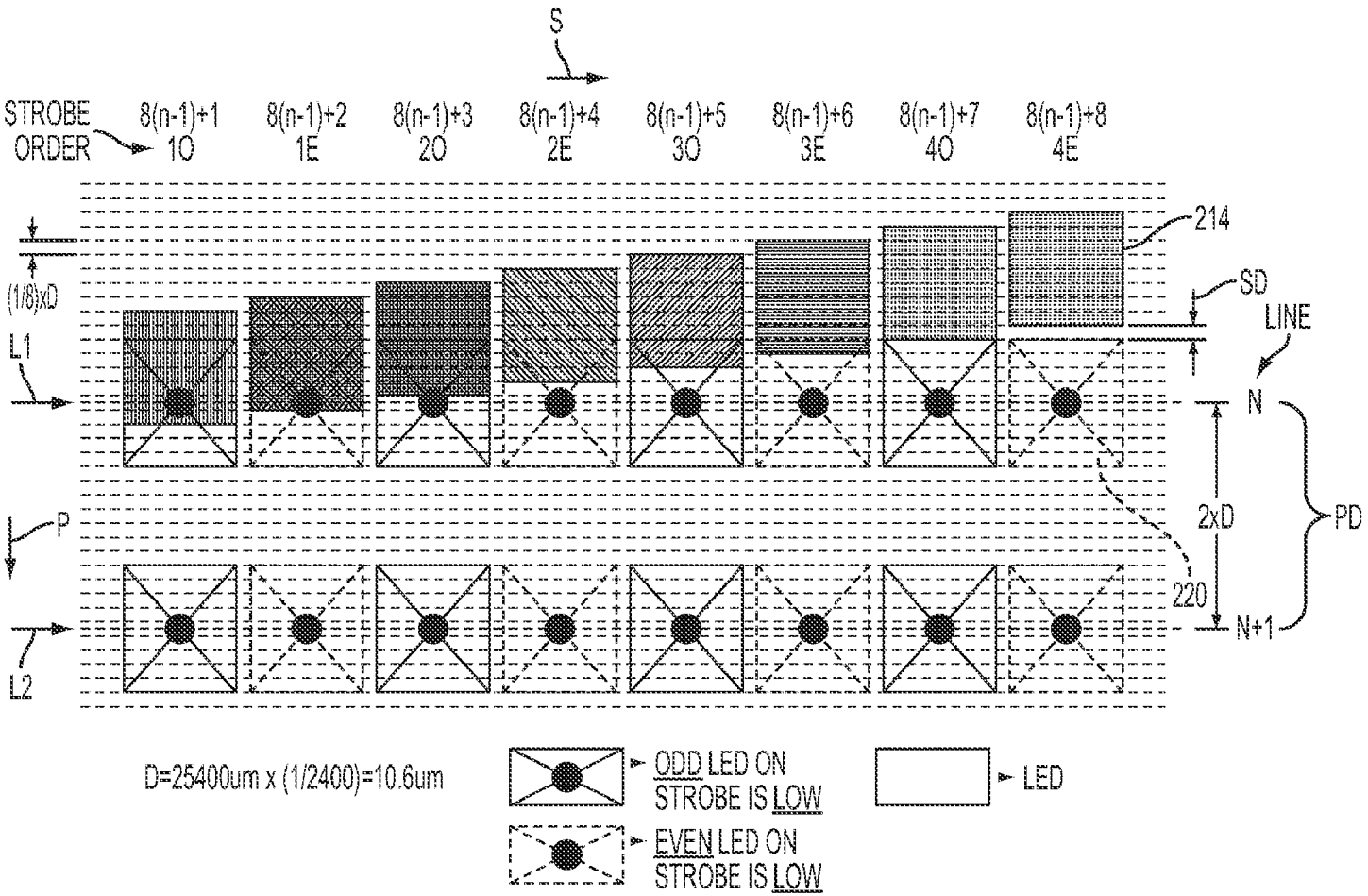
FIG. 9 shows respective spot images for LEDs in FIG. 6 according to the chart of FIG. 7; and, FIG. 10 shows respective spot images for LEDs in FIG. 6 according to the chart of FIG. 9.

FIG. 9 shows respective spot images for LEDs in FIG. 6 according to the chart of FIG. 7. In an example embodiment, print-head 200 operates with a resolution of 1200 dpi in scan direction S and the independent timing and control shown in chart in FIG. 7 enables 1200 dpi resolution in process direction P.

Figure 10:
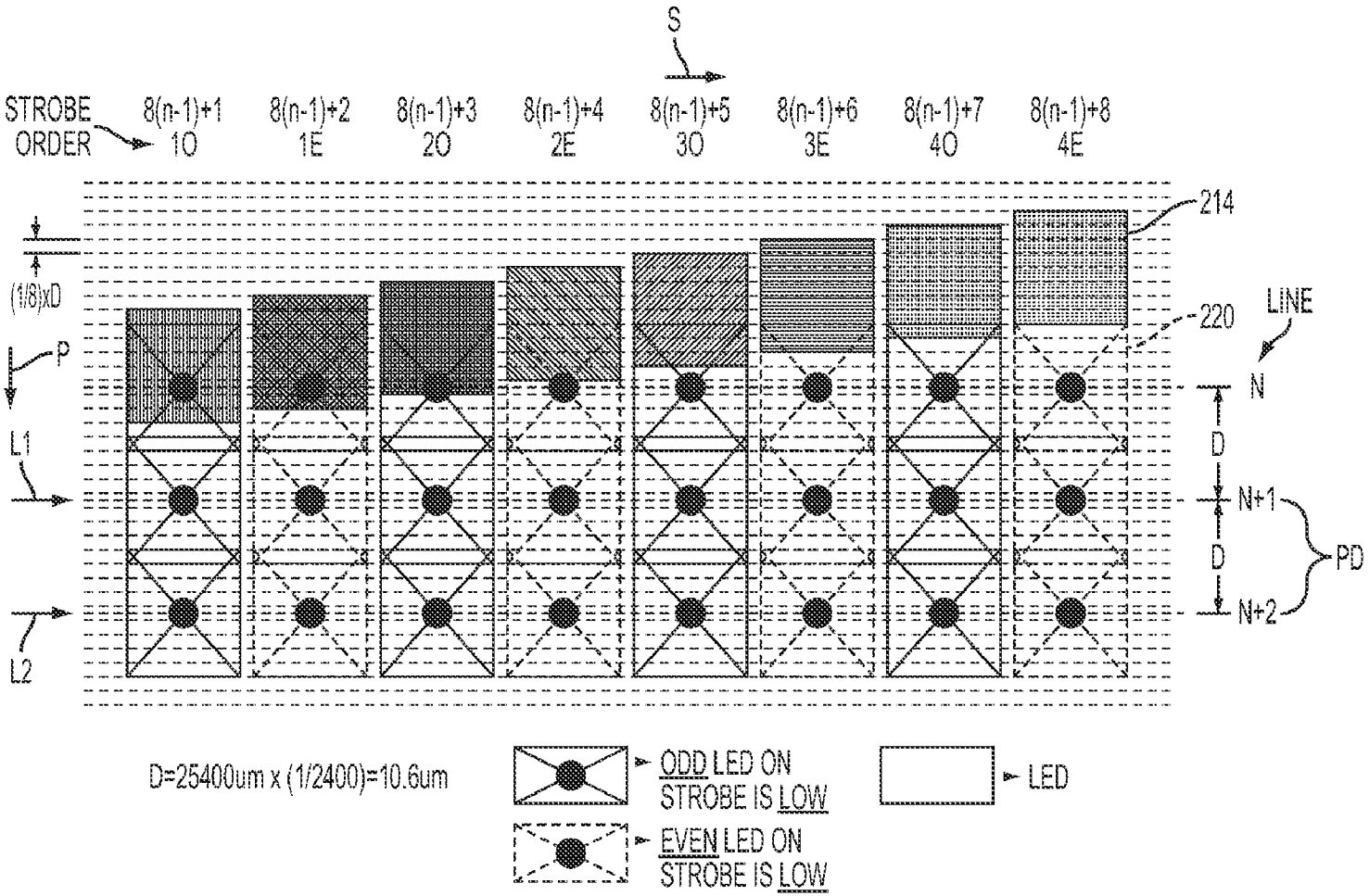

FIG. 10 shows respective spot images for LEDs in FIG. 6 according to the chart of FIG. 8. In an example embodiment, print-head 200 operates with a resolution of 1200 dpi in scan direction S and the independent timing and control shown in chart in FIG. 8 enables 2400 dpi resolution in process direction P. It should be understood that print-head 200 is not limited to the scan and process resolutions described herein. The following should be viewed in light of FIGS. 5 through 10. Adjacent scan lines, for example, L1 and L2 in FIGS. 9 and 10 are separated by distance PD in the process direction. For a resolution of 1200 dpi (FIGS. 7 and 9), PD is double the PD for a resolution of 2400 dpi as shown in FIGS. 8 and 10. The difference in PD reflects the increased printing speed in the P direction for 1200 dpi process resolution. As further described infra, this difference in spacing of adjacent lines also results in optimal print quality while retaining maximum printing speed for 1200 dpi×1200 dpi printing. For example, spurious scan lines are not created as described supra for print-head 100.

Figure 1:
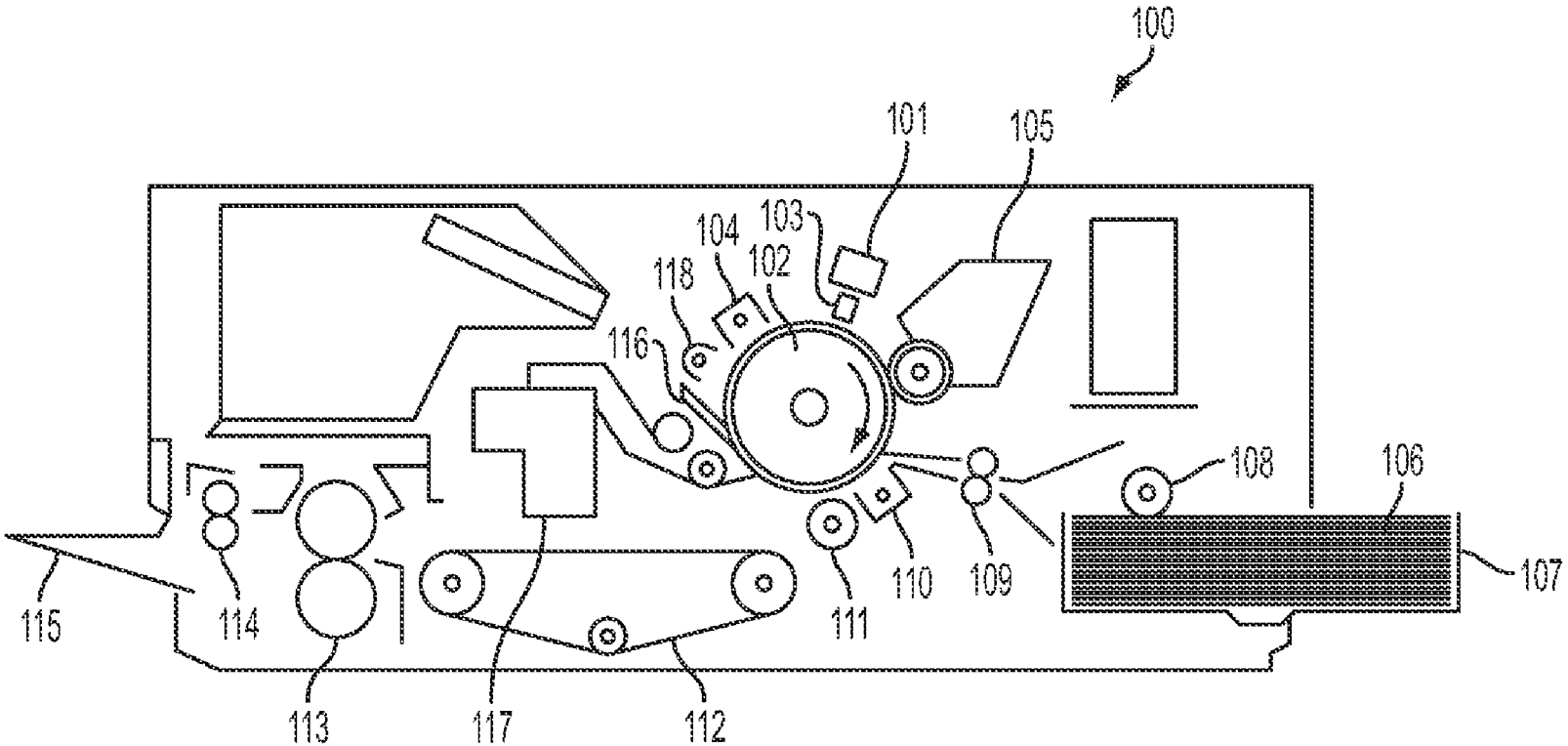
FIG. 1 schematically shows a prior art image recording apparatus with a light-emitting diode (LED) print-head.
Figure 2A:
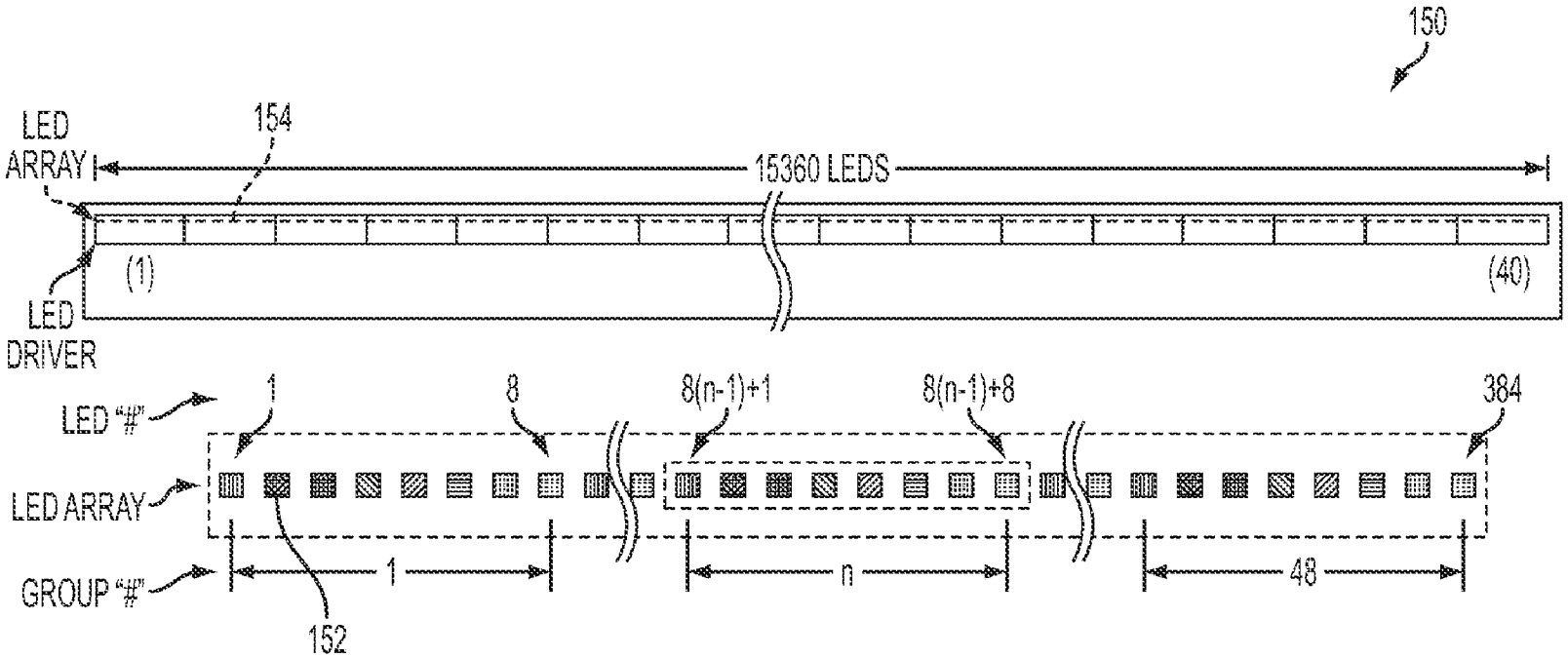
FIG. 2A PRIOR ART
FIG. 2A illustrates a prior art 1200 dots per inch (dpi), scan direction, print-head implementing a matrix drive with an integrated LED/Driver.
Figure 2B:
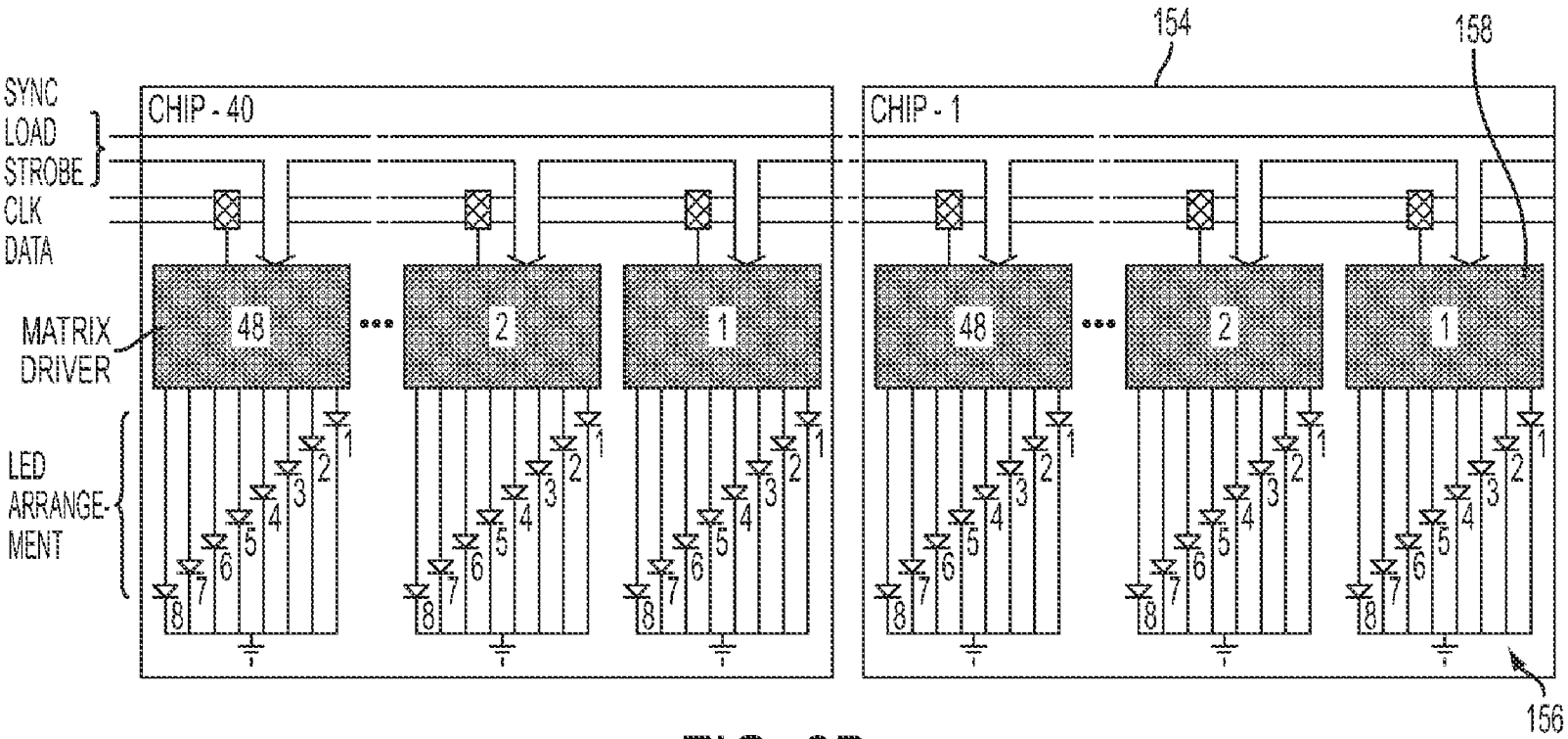
FIG. 2B PRIOR ART
FIG. 2B is a block diagram of chips from the print-head in FIG. 2A.
Figure 2C:
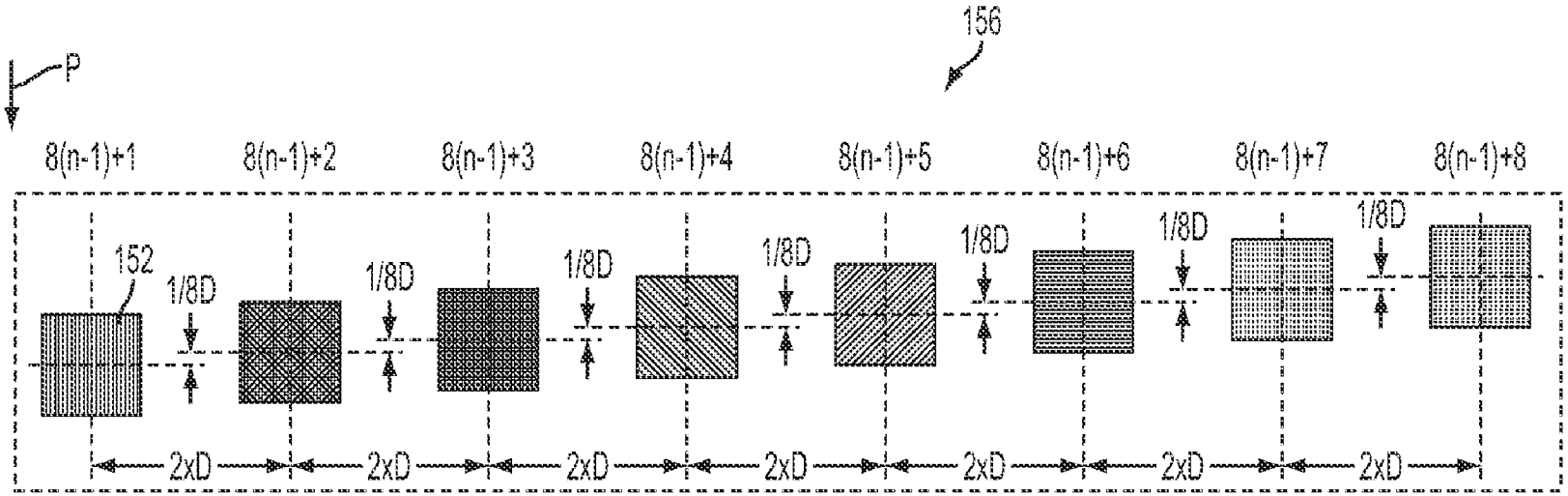
FIG. 2C PRIOR ART
FIG. 2C shows a group of LEDs for a chip in FIG. 2A.
Figure 3A:
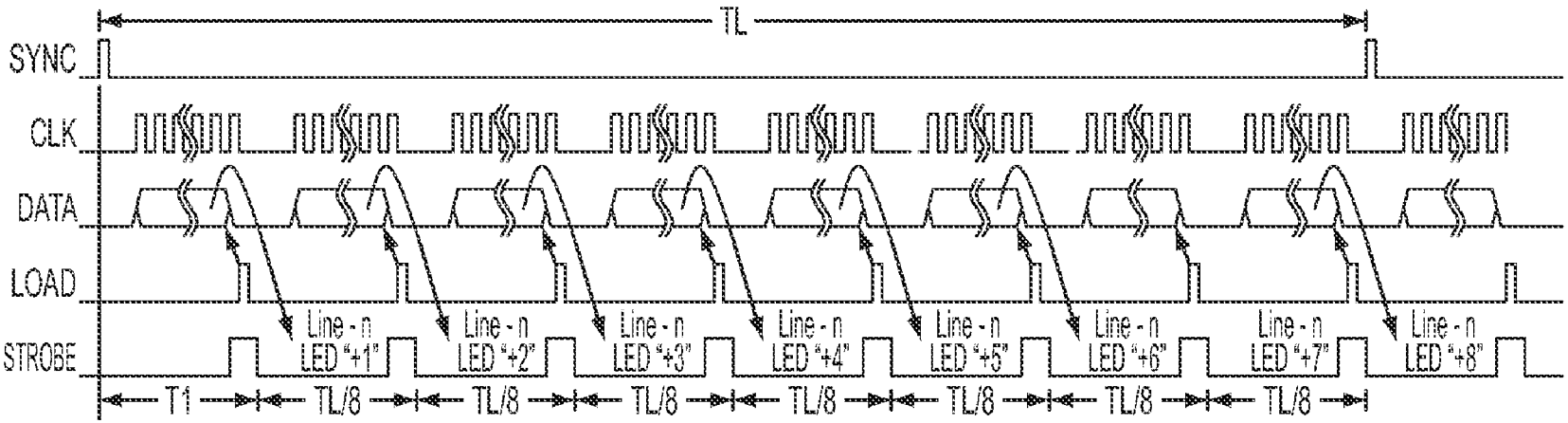
FIG. 3A PRIOR ART
FIG. 3A is a prior art matrix drive timing chart for the group of LEDs shown in FIG. 2C.
Figure 3B:
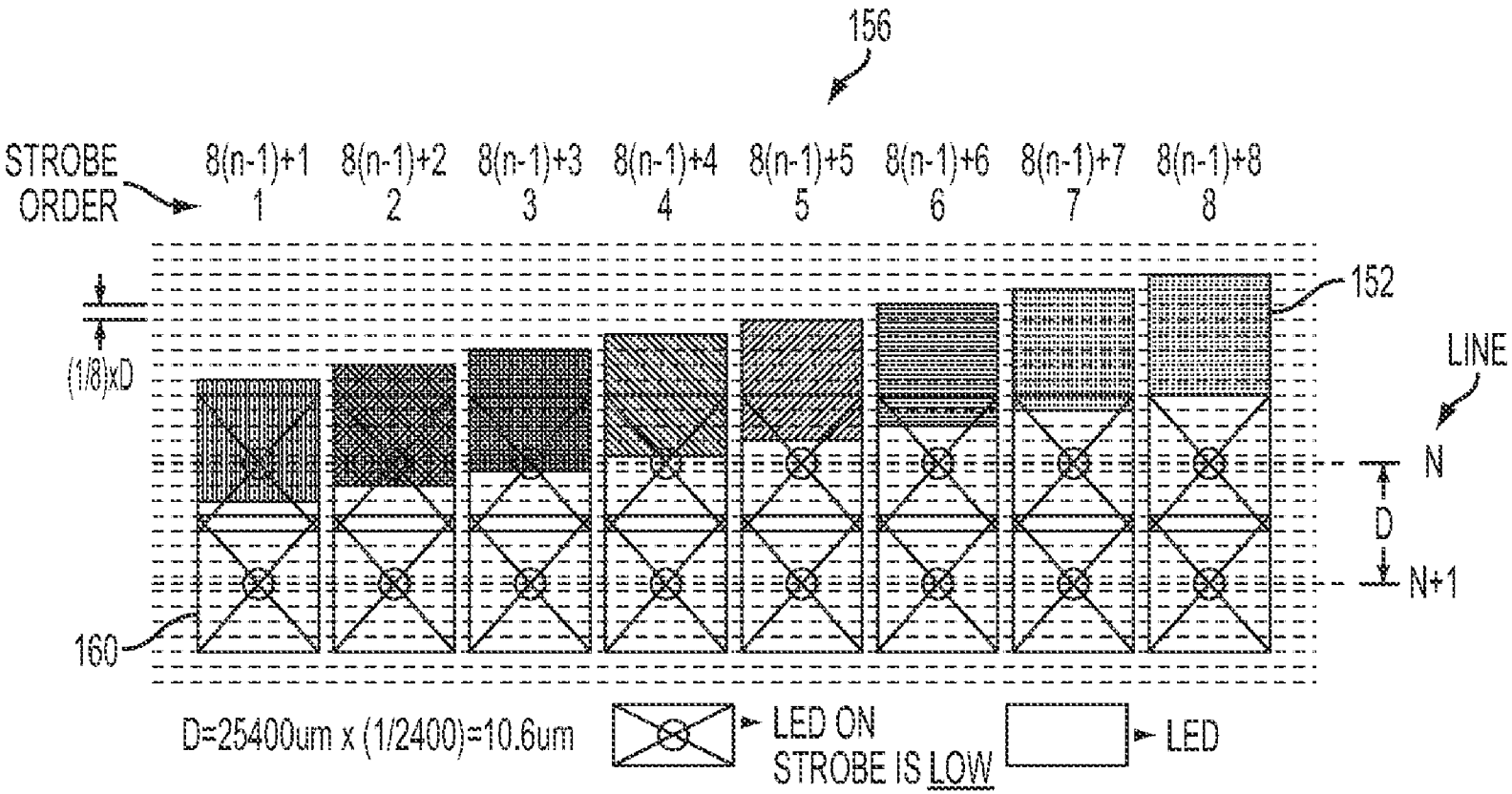
FIG. 3B PRIOR ART
FIG. 3B shows respective spot images for LEDs in FIG. 2C at 1200 dpi×2400 dpi resolution according to the chart of FIG. 3A.
Figure 3C:
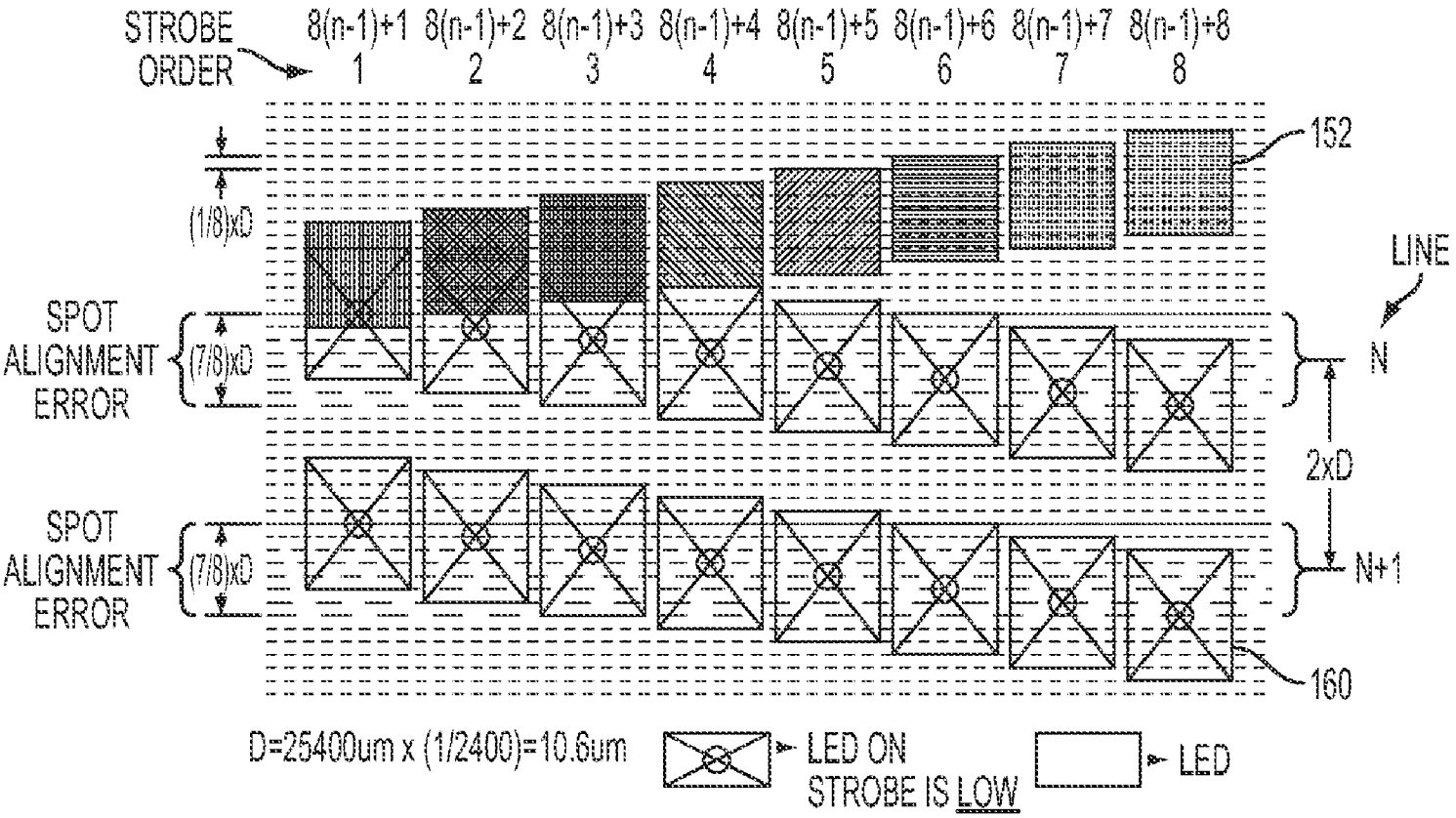
FIG. 3C PRIOR ART
FIG. 3C shows respective spot images for a group of LEDs in FIG. 2C at 1200 dpi×1200 dpi resolution according to the chart of FIG. 3A.

The configuration and timing shown in FIGS. 5 through 10 addresses the process, speed, misalignment, and power problems noted supra for print-head 100. For example, regarding spot image misalignment, for operation of print-head 200, using the same hardware, configuration (for example, adjacent LEDs are offset by D/8 opposite the process direction), and independent matrix drive control shown in both FIGS. 5 and 6, at 1200 dpi in the scan direction and either 1200 dpi or 2400 dpi in the process direction, respective spot images for each group of LEDs are substantially fully aligned in the scan direction. By "substantially fully aligned" we mean that the spot images are aligned in the S direction according to the tolerances for the placement of the respective LEDs in the P direction. For example, if the staggering/spacing of adjacent LEDs is exactly D/8, then there is exact alignment for the spot images in the scan direction. However, if the spacing of for a pair of adjacent LEDs is not exactly D/8 in the P direction, the respective spot images are misaligned in the S direction by an amount about equal to the variance in the desired spacing for the adjacent LEDs. For example, if the spacing of adjacent LEDs is 5D/32 instead of D/8, the respective spot images are staggered by D/32 opposite the P direction and thus misaligned by that amount in the S direction. For example, the spot alignment error of 7D/8 shown in FIG. 3C is eliminated.

As noted supra, one prior art scheme for using a same hardware configuration for both 1200 dpi×1200 dpi resolution and 1200 dpi and 2400 dpi resolution involves reducing TA for an 8 LED group to TL/16, resulting in unacceptable power loss. However, TA for each LED in groups 212 is no less than TL divided by the number of LEDs in a group 212, for example, eight. Thus, the shortest duration for TL in FIGS. 7-10 is TL/8 in FIG. 7 for 1200×120 dpi process resolution. Thus, using the single hardware configuration shown in FIG. 6 and the independent timing control shown in FIGS. 7 and 8, high quality printing and maximum process speed for both 1200 dpi×1200 dpi resolution and 1200 dpi and 2400 dpi resolution are enabled in print-head 200.

As noted supra, one prior art scheme for using a same hardware configuration for both 1200 dpi×1200 dpi resolution and 1200 dpi and 2400 dpi resolution involves operating a print-head at 1200 dpi×2400 dpi resolution and ignoring every other line to obtain 1200 dpi×1200 dpi resolution. However, this scheme sacrifices the higher print speeds possible for 1200 dpi×1200 dpi resolution. In contrast, and as noted above, for operation of print-head 200 at 1200 dpi×1200 dpi resolution using the hardware configuration shown in FIG. 6 and the independent timing control shown in FIG. 7, PD is twice the PD for operation of print-head 200 at 1200 dpi× 2400 dpi resolution. That is, optimal print quality is obtained while preserving the desirably higher printing rate possible for 1200 dpi×1200 dpi resolution.

Thus, TA and TOE are equal to time period TL divided by respective values selected according to a desired resolution of the print head, for example, in the process direction. For example, to support 1200 dpi×2400 dpi resolution, a larger TA is required (as shown in FIG. 8) and accordingly, TA is equal to TL/4 and the entire period TL is needed for the activation of all the LEDs in group 212. For example, to support 1200 dpi and 1200 dpi resolution, while maintaining a higher printing speed, a smaller TA is required (as shown in FIG. 7) and accordingly, TA is equal to TL/8 and only half of TL is needed for the activation of all the LEDs in group 212. The use of only half of TL is reflected in the increased size of PD in FIG. 9 with respect to PD in FIG. 10, for example, PD in FIG. 9 is twice PD in FIG. 10. TOE varies accordingly, for example, TOE in FIG. 8 is TL/8.

Advantageously, the arrangement of groups 212 into independent groups 216 and 218 in conjunction with independent matrix drivers 204 and 206 and independent channels 208 and 210, enable independent control of individual LEDs and the operation of print-head 200 in both 1200 dpi×1200 dpi resolution and 1200 dpi×2400 dpi resolution without loss of print quality or printing speed. For example, the arrangement and independent control enable the use of strobing to electronically adjust an effective offset between individual LEDs in chips 202. For example, the spot alignment error noted supra is eliminated, double print speed for 1200 dpi×1200 dpi resolution is enabled (with respect to 1200 dpi×2400 dpi resolution), and maximum LED power, for example TL/8 for 120 dpi×1200 dpi resolution and TL/4 for 1200 dpi×2400 dpi resolution, is enabled.

It should be understood that the discussion supra regarding chips 204 in print-head 200 are applicable to individual chips 204, for example, prior to being placed in an array or print-head.

Although the examples above show or reference a specific number, type, and configuration of components, it should be understood that according to aspects illustrated herein, other numbers, types, or configurations of components are possible.

It will be appreciated that variations of the above-disclosed and other features and functions, or alternatives thereof, may be desirably combined into many other different systems or applications. Variations presently unforeseen or unanticipated alternatives, modifications, variations, or improvements therein may be subsequently made by those skilled in the art which are also intended to be encompassed by the following claims.

What I claim is:

1. A print head, comprising:

a plurality of chips disposed and aligned, in a scan direction, in a linear array;

respective pluralities of first and second matrix drivers on each chip connected to first and second channels, respectively; and, for each chip, first groups of light-emitting diodes (LEDs), each first group of LEDs including:

a respective second group of LEDs, every LED in the respective second group of LEDs connected to a respective first matrix driver; and, a respective third group of LEDs, different from the respective second group of LEDs, every LED in the respective third group of LEDs connected to a respective second matrix driver, different from the respective first matrix drive, wherein:

LEDs in said each first group of LEDs are disposed in a staggered arrangement in a process direction orthogonal to the scan direction such that all LEDs from the second group of LEDs alternate in the process direction with respective LEDs in the third group of LEDs; and, the respective pluralities of first and second matrix drivers are for activating in sequence the LEDs in the second and third groups of LEDs, respectively.

2. The print head of claim 1 wherein:

the second group of LEDs is a group of odd LEDs including a first number of LEDs;

the third group of LEDs is a group of even LEDs including the first number of LEDs;

and, the respective pluralities of first and second matrix drivers are for individually activating, in sequence, the LEDs in the staggered arrangement.

3. A method of operating a print head, comprising:

disposing and aligning, in a scan direction, a plurality of chips in an array in the print head, each chip including first groups of light-emitting diodes (LEDs), and each first group of LEDs including a respective second group of LEDs and a respective third group of LEDs;

connecting respective pluralities of first and second matrix drivers on each chip to first and second channels, respectively;

connecting each respective second group of LEDs to a respective first matrix drivers;

connecting each respective third group of LEDs to a respective second matrix driver different from the respective first matrix driver;

disposing, in a process direction orthogonal to the scan direction, LEDs in said each first group of LEDs in a staggered arrangement such that no LED in said each first group of LEDs is wholly aligned in the scan direction with another LED in said each first group of LEDs; and, activating in sequence the LEDs in the second and third groups of LEDs using the respective first and second matrix drivers, respectively.

4. The method of claim 3 wherein:

the second group of LEDs is a group of odd LEDs with a first number of LEDs;

the third group of LEDs is a group of even LEDs with the first number of LEDs;

LEDs from the group of odd LEDs alternate with LEDs from the group of even LEDs in the staggered arrangement; and, the respective pluralities of first and second matrix drivers are for individually activating, in sequence, the LEDs in the staggered arrangement.

5. A chip for a print head, comprising:

first and second pluralities of matrix drivers connected to first and second channels, respectively; and, first groups of light-emitting diodes (LEDs) disposed and aligned in a scan direction along the chip, each first group of LEDs including:

a respective second group of LEDs connected to a respective first matrix driver; and, a respective third group of LEDs connected to a respective second matrix driver, different from the respective first matrix driver, wherein:

LEDs in said each first group of LEDs are disposed in a staggered arrangement such that all LEDs in the respective second group of LEDs alternate with respective LEDs in the respective third group of LEDs in the process direction; and, the first and second pluralities of matrix drivers are for activating in sequence the LEDs in the second and third groups of LEDs, respectively.

6. The chip of claim 5 wherein:

the second group of LEDs is a group of odd LEDs with a first number of LEDs;

the third group of LEDs is a group of even LEDs with the first number of LEDs;

LEDs from the group of odd LEDs alternate with LEDs from the group of even LEDs in the staggered arrangement; and, the first and second pluralities of matrix drivers are for individually activating, in sequence, the LEDs in the staggered arrangement.

* * * * *